US006517158B1

(12) United States Patent
Wang

(10) Patent No.: US 6,517,158 B1
(45) Date of Patent: Feb. 11, 2003

(54) HEIGHT-ADJUSTABLE ARMREST ASSEMBLY

(76) Inventor: Ching-Chang Wang, No.200, Lane 545, Sec.1, Yuang Shing Rd., Wuchi, Taichung Hsien (TW)

( * ) Notice: Subject to any disclaimer, the term of this patent is extended or adjusted under 35 U.S.C. 154(b) by 0 days.

(21) Appl. No.: 09/977,853

(22) Filed: Oct. 16, 2001

(51) Int. Cl.[7] ..... A47C 7/54

(52) U.S. Cl. ..... 297/411.36; 297/411.28; 297/353; 297/411.27; 248/118.3

(58) Field of Search ..... 297/411.28, 411.36, 297/411.26, 411.27, 353, 115, 117, 35, 38, 40; 248/118.3

(56) References Cited

U.S. PATENT DOCUMENTS 4,828,323 A * 5/1989 Brodersen et al. ..... 297/411.36
5,611,594 A * 3/1997 Findlay ..... 297/28
5,769,497 A * 6/1998 Tsai ..... 297/411.36
5,931,526 A * 8/1999 Tseng ..... 297/27
6,062,647 A * 5/2000 Mei ..... 297/411.36
6,209,840 B1 * 4/2001 Chen ..... 248/407
6,343,840 B1 * 2/2002 Chuang ..... 297/411.36
6,419,323 B1 * 7/2002 Chu et al. ..... 297/411.36

* cited by examiner

*Primary Examiner*—Peter M. Cuomo
*Assistant Examiner*—Erika Garrett
(74) *Attorney, Agent, or Firm*—Charles E. Baxley

(57) ABSTRACT

An armrest assembly comprises an armrest having an end pivotally attached to a backrest of the chair, a fixing member having an end fixed to a seat of the chair, and an adjusting device having an end engaged with the other end of the armrest in a manner allowing relative sliding movement therebetween when the end of the armrest pivots. The other end of the adjusting device is slidably engaged with the other end of the fixing member such that movement of the adjusting device relative to the fixing member causes a change in a height of the armrest.

20 Claims, 10 Drawing Sheets

A-A

B–B

C-C

HEIGHT-ADJUSTABLE ARMREST ASSEMBLY

BACKGROUND OF THE INVENTION

1. Field of the Invention

The present invention relates to a height-adjustable armrest assembly.

2. Description of the Related Art

U.S. Design Pat. No. 426,408 issued to Su on Jun. 13, 2000 discloses an armrest that is secured to the seat in a rigid manner. However, its height is not adjustable. U.S. Pat. No. 5,664,842 issued to Tseng on Sep. 9, 1997 discloses a height-adjustable armrest unit for a chair. However, the height-adjustable armrest unit can only be used with a small-size chair. In addition, the height-adjustable armrest unit is supported by the seat at only one point and thus can only bear a low load. Namely, the height-adjustable armrest unit will be damaged when it is subject to a higher load.

SUMMARY OF THE INVENTION

In accordance with a first aspect of the invention, an armrest assembly comprises:

an armrest having a first end pivotally attached to a backrest of the chair and a second end;

a fixing member having a first end fixed to a seat of the chair and a second end; and an adjusting means having a first end engaged with the second end of the armrest in a manner allowing relative sliding movement therebetween when the first end of the armrest pivots, the adjusting means further having a second end slidably engaged with the second end of the fixing member such that movement of the adjusting means relative to the fixing member causes a change in a height of the armrest, and the adjusting means and the fixing member being so configured that the adjusting means and the fixing member are engaged together when the adjusting means is in a first position and that the adjusting means and the fixing member are movable relative to each other when the adjusting means is in a second position.

In accordance with a second aspect of the invention, an armrest assembly comprises:

a bracket securely attached to one of a seat of a chair and a backrest of the chair, the bracket having a first end and a second end, an armrest having a first end pivotally attached to the first end of the bracket and a second end;

a fixing member having a first end fixed to the second end of the seat and a second end; and an adjusting means having a first end engaged with the second end of the armrest in a manner allowing relative sliding movement therebetween when the first end of the armrest pivots, the adjusting means further having a second end slidably engaged with the second end of the fixing member such that movement of the adjusting means relative to the fixing member causes a change in a height of the armrest, and the adjusting means and the fixing member being so configured that the adjusting means and the fixing member are engaged together when the adjusting means is in a first position and that the adjusting means and the fixing member are movable relative to each other when the adjusting means is in a second position.

In accordance with a third aspect of the invention, an armrest assembly comprises:

an armrest having a first end pivotally attached to a backrest of a chair and a second end;

a fixing member having a first end pivotally attached to a seat of the chair and a second end; and an adjusting means having a first end securely engaged with the second end of the armrest, the adjusting means further having a second end slidably engaged with the second end of the fixing member such that movement of the adjusting means relative to the fixing member causes a change in a height of the armrest, and the adjusting means and the fixing member being so configured that the adjusting means and the fixing member are engaged together when the adjusting means is in a first position and that the adjusting means and the fixing member are movable relative to each other when the adjusting means is in a second position.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
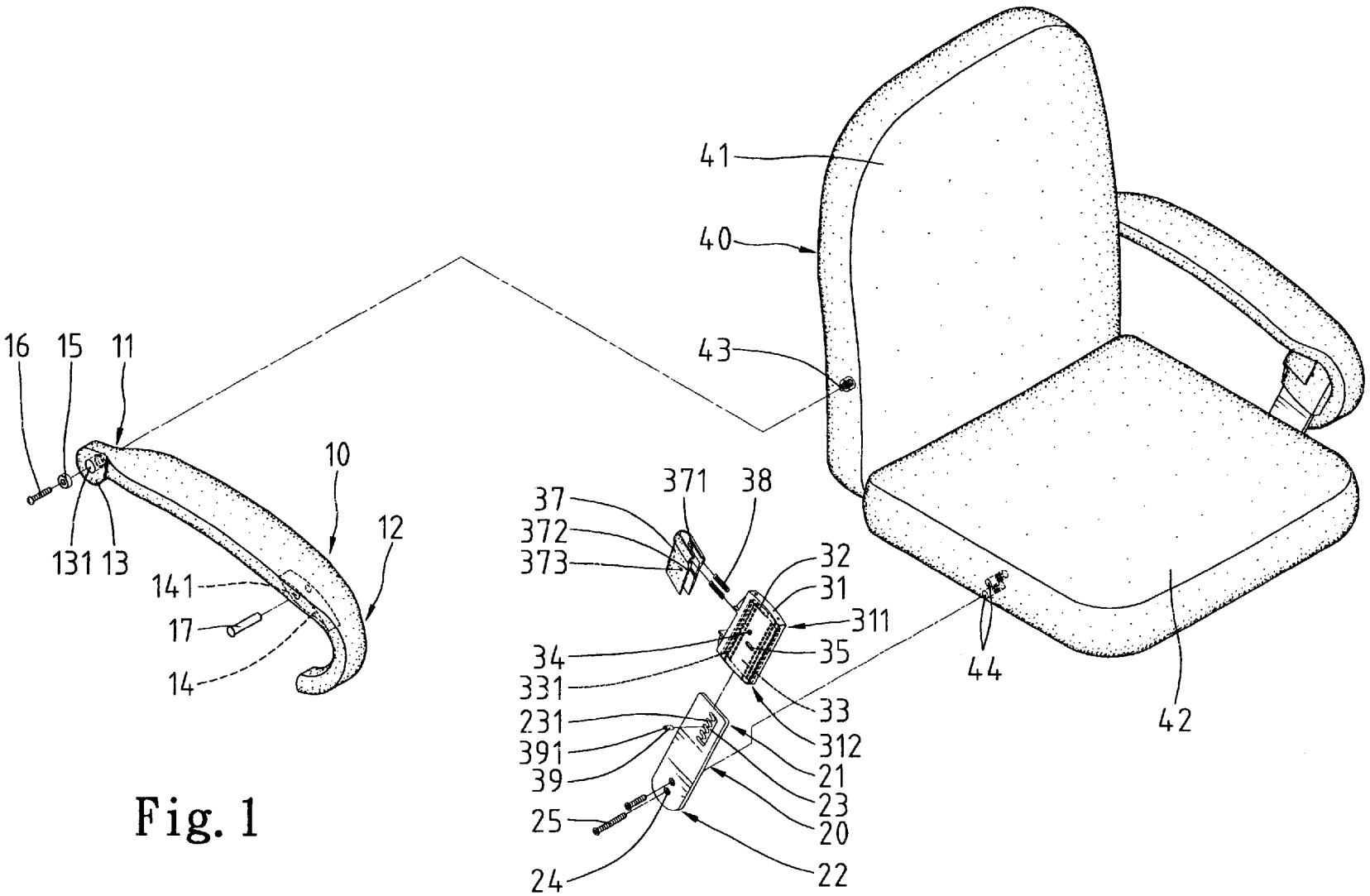
FIG. 1 is an exploded perspective view of a chair having a height-adjustable armrest assembly in accordance with the present invention.
Figure 2:
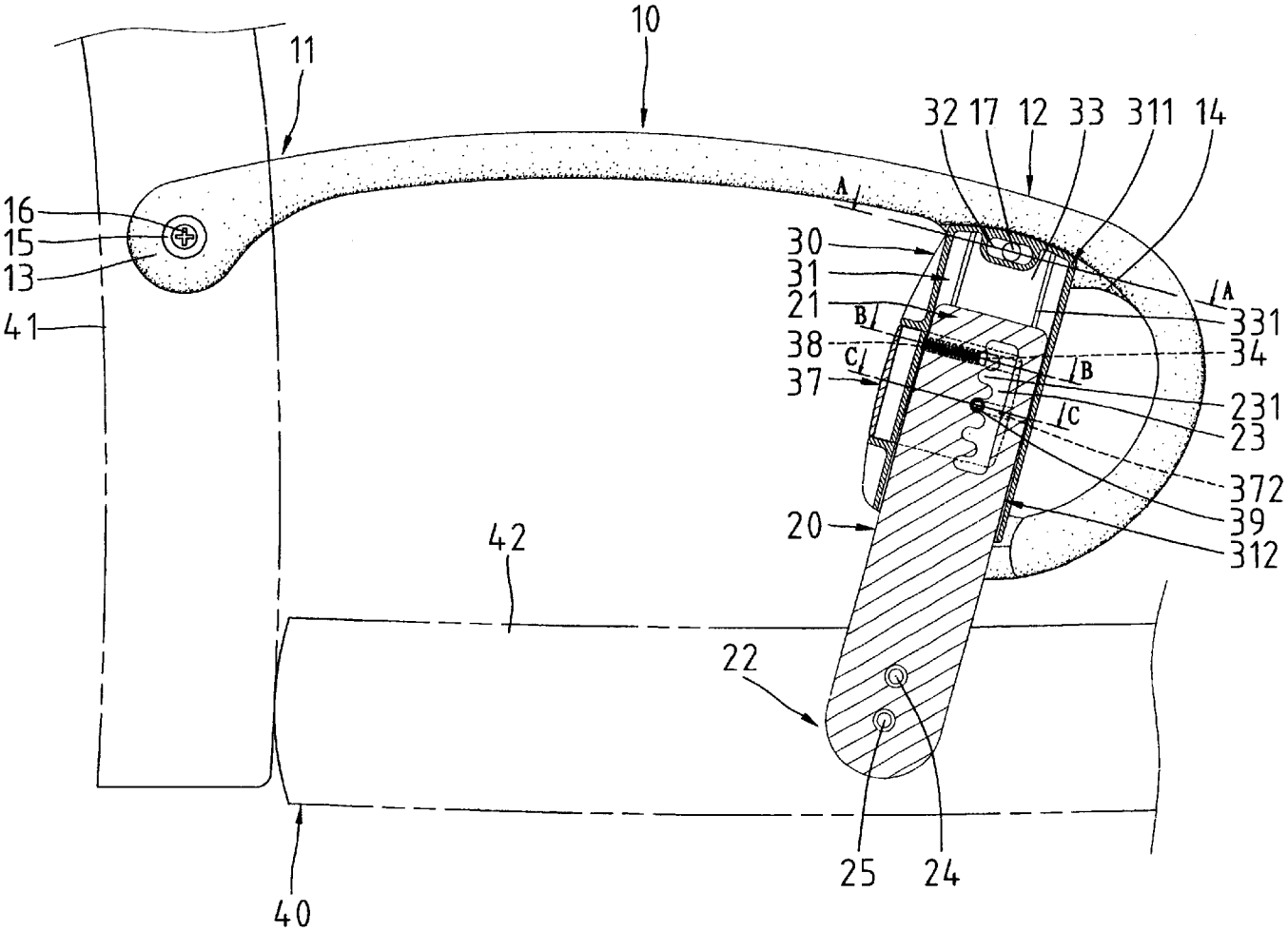
FIG. 2 is an enlarged side view, partly sectioned, of a portion of the chair.

Referring to FIGS. 1 and 2, a chair in accordance with the present invention generally comprises a seat 42, a backrest 41, and two armrest assemblies on both sides of the seats 42. Each armrest assembly comprises an armrest 10, a fixed member 20, and an adjusting means 30. The armrest 10 comprises a first end 11 and a second end 12. The first end 11 of the armrest 10 comprises an engaging portion 13 having a transverse stepped hole 131. A bearing 15 is mounted in a portion of the transverse stepped hole 131, and a bolt or screw 16 is extended through a central hole (not labeled) of the bearing 15, the remaining portion of the transverse stepped hole 131, and a screw hole 43 in a side of the backrest 41 to thereby allow pivotal movement of the first end 11 of the armrest 10 about an axis of the screw 16.

The second end 12 of the armrest 10 comprises an engaging groove 14 in an underside thereof, a pinhole 141 being defined in a sidewall defining the engaging groove 14, which will be described later.

The fixing member 20 comprises a first end 21 and a second end 22. A positioning means 23 in the form of a row of vertically spaced positioning notches 231 is provided on the first end 21 of the fixing member 20. Two holes 24 are defined in the second end 22 of the fixing member 20. Two bolts or screws 25 are respectively extended through the holes 24 of the fixing member 20 and two screw holes 44 in a side of the seat 42. Thus, the second end 22 of the fixing member 20 is fixed to the seat 40.

The adjusting means 30 comprises a block 31 and a control member 37. The block 31 comprises a first end 311 in which a transverse guide slot 32 is defined. A compartment 33 is defined in the block 31 and has an opening located in a second end 312 of the block 31. The compartment 33 is communicated with the transverse guide slot 32. Each of two sides of the block 31 further has a transverse engaging slot 35 communicated with the compartment 33 and a protrusion 34.

Figure 4:
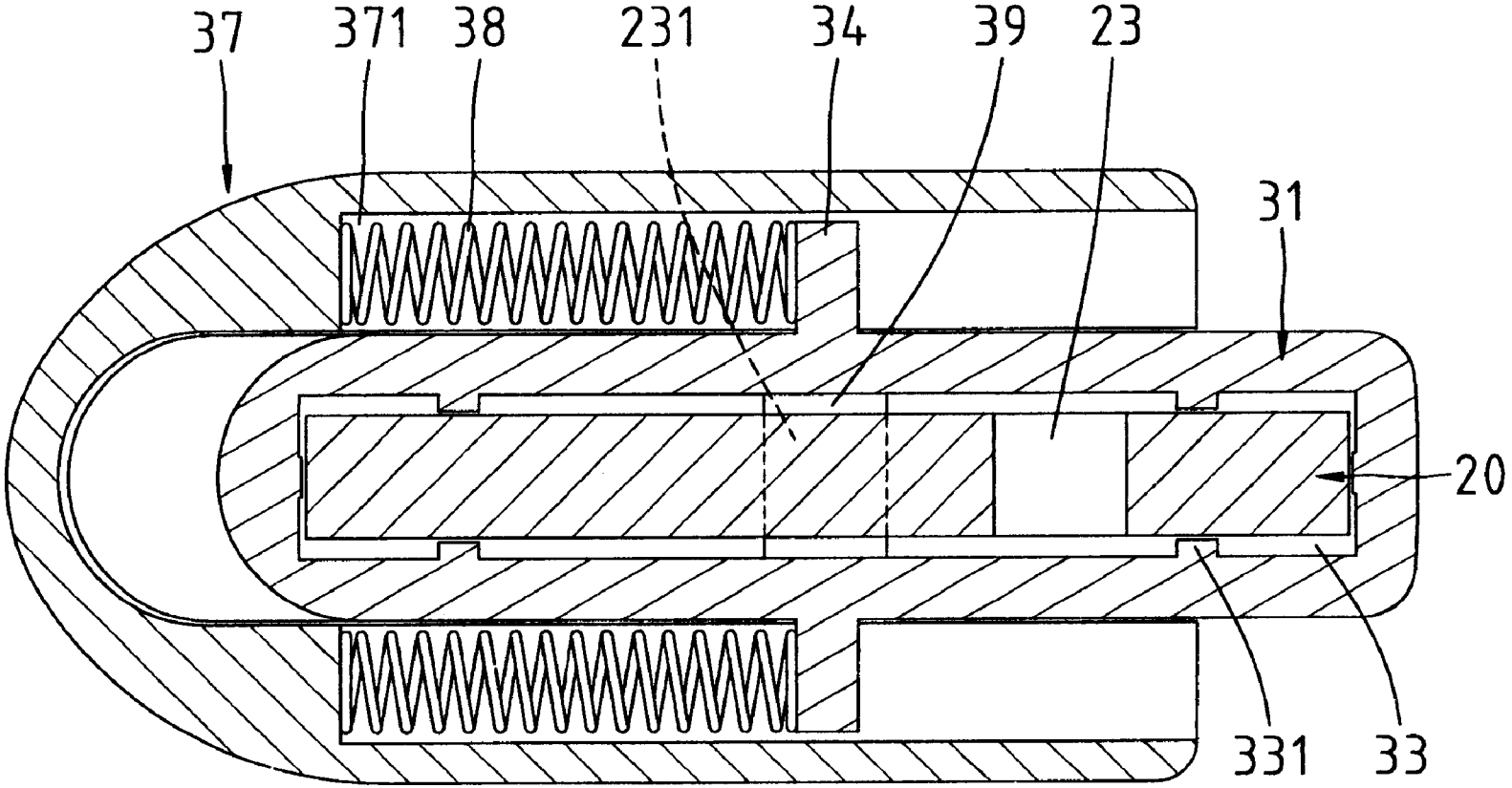
FIG. 4 is a sectional view taken along line B—B in FIG. 2.
Figure 5:
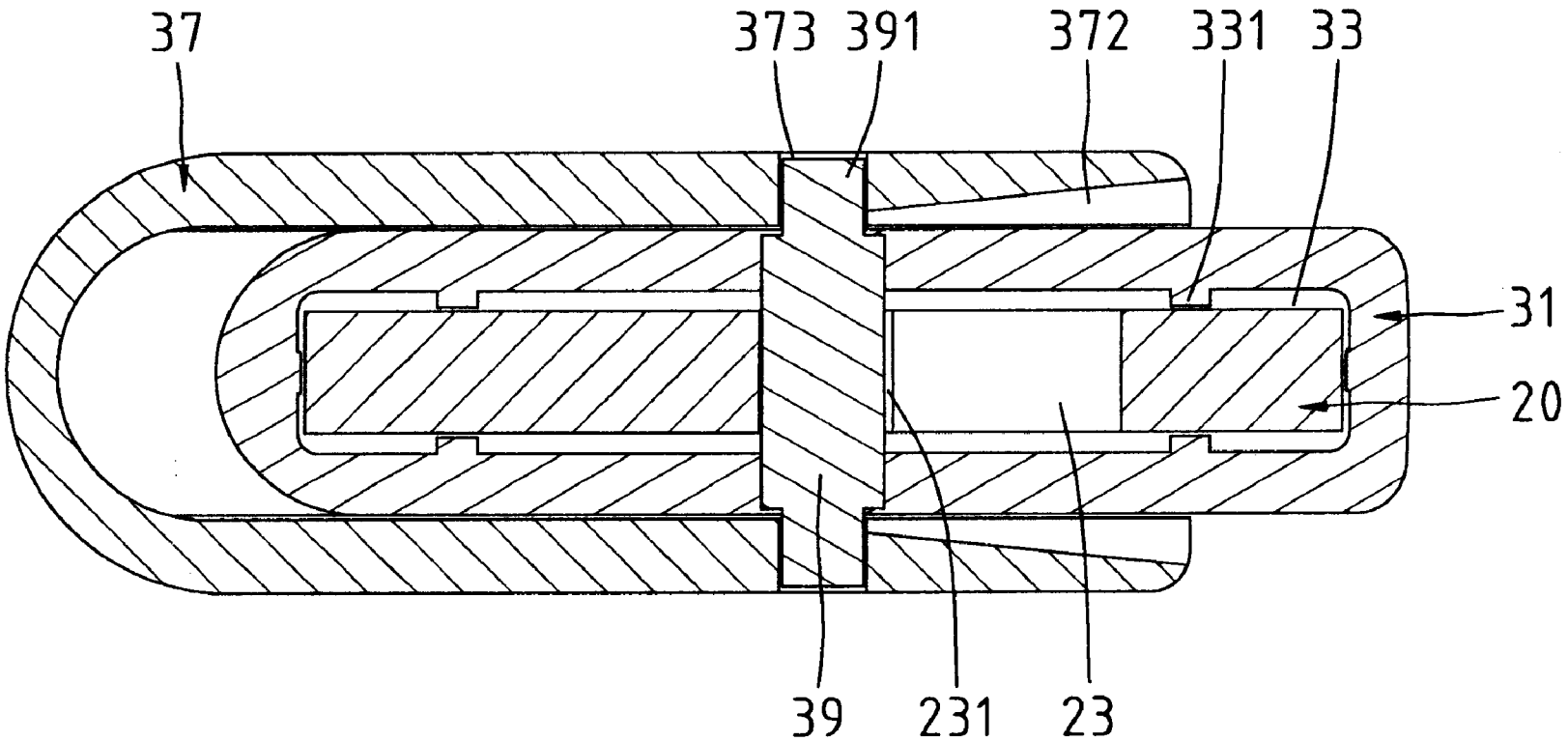
FIG. 5 is a sectional view taken along line C—C in FIG. 2.

The control member 37 is substantially U-shaped and has two sidewalls (not labeled) that embrace the block 31 (FIG. 4) and a connecting section (not labeled) between the sidewalls. Each sidewall has a groove 371 in an end of an inner face thereof for receiving an elastic element 38, as shown in FIG. 4. Each sidewall further has a guide groove 372 in an intermediate portion of the inner face thereof. A transverse positioning hole 373 extends through the sidewalls of the control member 37 and intersecting an end of the guide groove 372 in each sidewall, as shown in FIG. 5.

Figure 3:
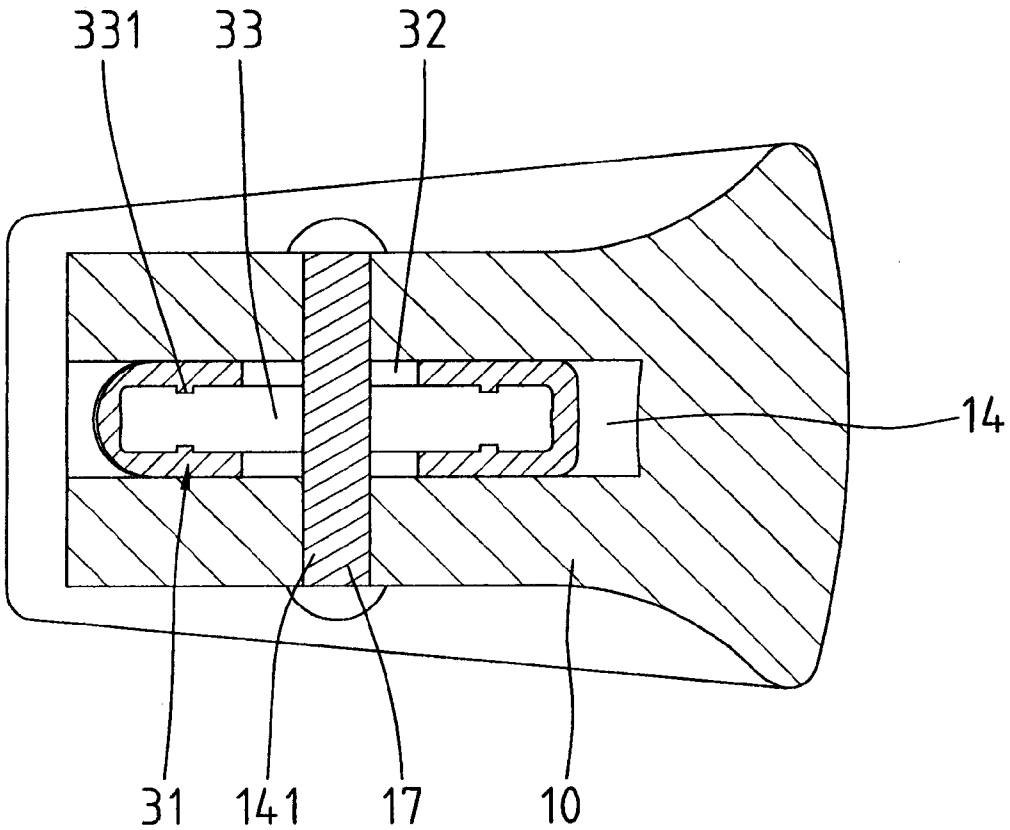
FIG. 3 is a sectional view taken along line A—A in FIG. 2.

In assembly, the first end 311 of the block 31 is placed in the engaging groove 14 of the second end 12 of the armrest 10. As illustrated in FIGS. 2 and 3, a pin 17 is extended through the pinhole 141 of the armrest 10 and the transverse guide slot 32 of the block 31, thereby allowing relative sliding movement between the first end 311 of the block 31 and the second end 12 of the armrest 10. Next, the compartment 33 of the second end 312 of the block 31 is moved to enclose the positioning means 23 of the fixed member 20. Then, a positioning pin 39 is inserted through the engaging hole 35 and the positioning means 23 with two reduced ends 391 of the positioning pin 39 being exposed outside the block 31. Next, the control member 37 is mounted to embrace the block 31. The reduced ends 391 of the positioning pin 39 slides along the guide groove 372 into the positioning hole 373. Thus, the positioning pin 39 is retained in the positioning hole 373. Each elastic elements 38 in the respective groove 371 of the control member 37 is attached to an associated engaging protrusion 34 to thereby biasing the control member 37 away from the fixing member 20, which, in turn, urges the positioning pin 39 to be engaged in one of the engaging notches 231.

Figure 6:
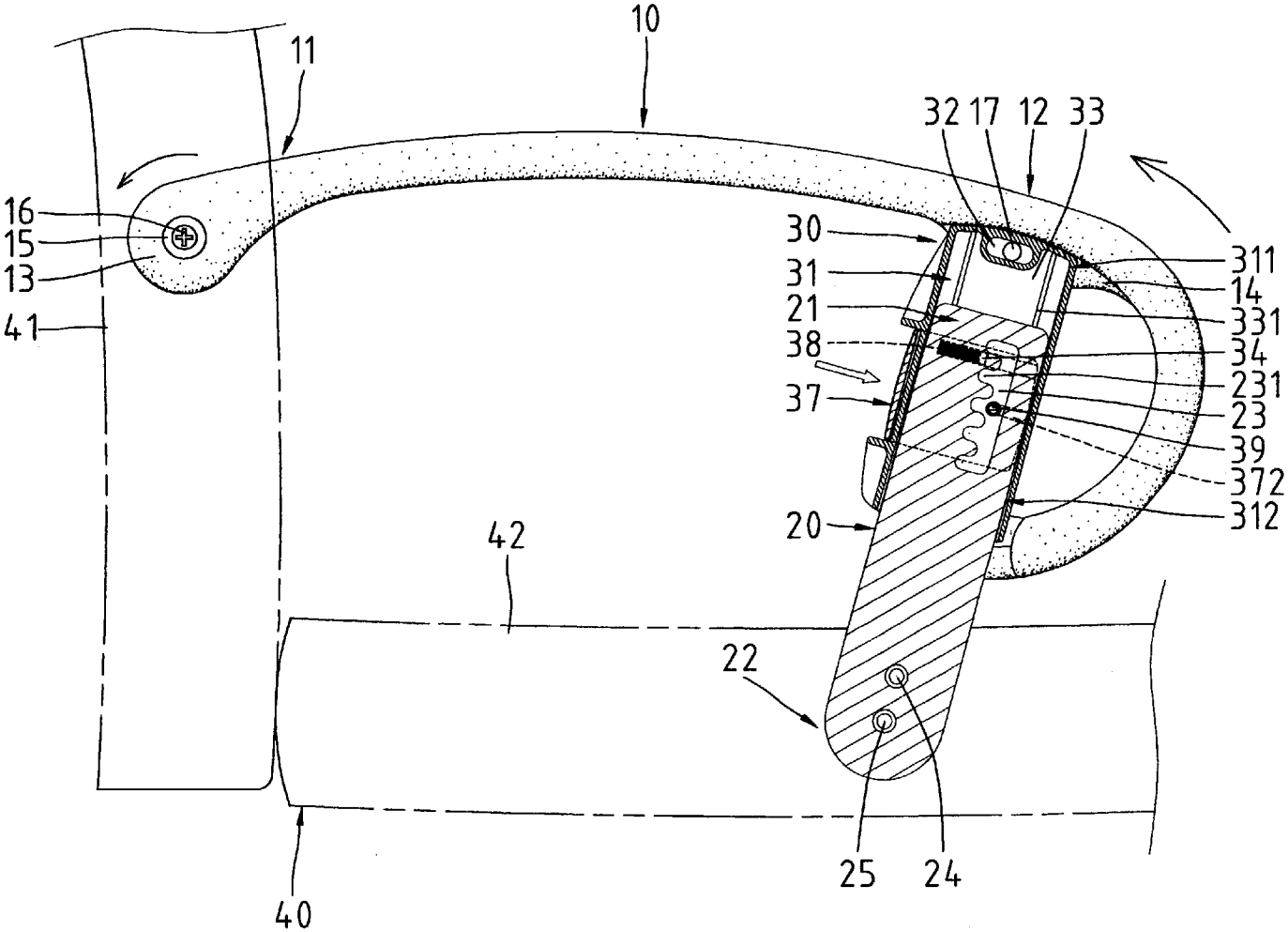
FIG. 6 is a view similar to FIG. 2, wherein a control member is pushed to proceed with height-adjustment of the armrest.
Figure 7:
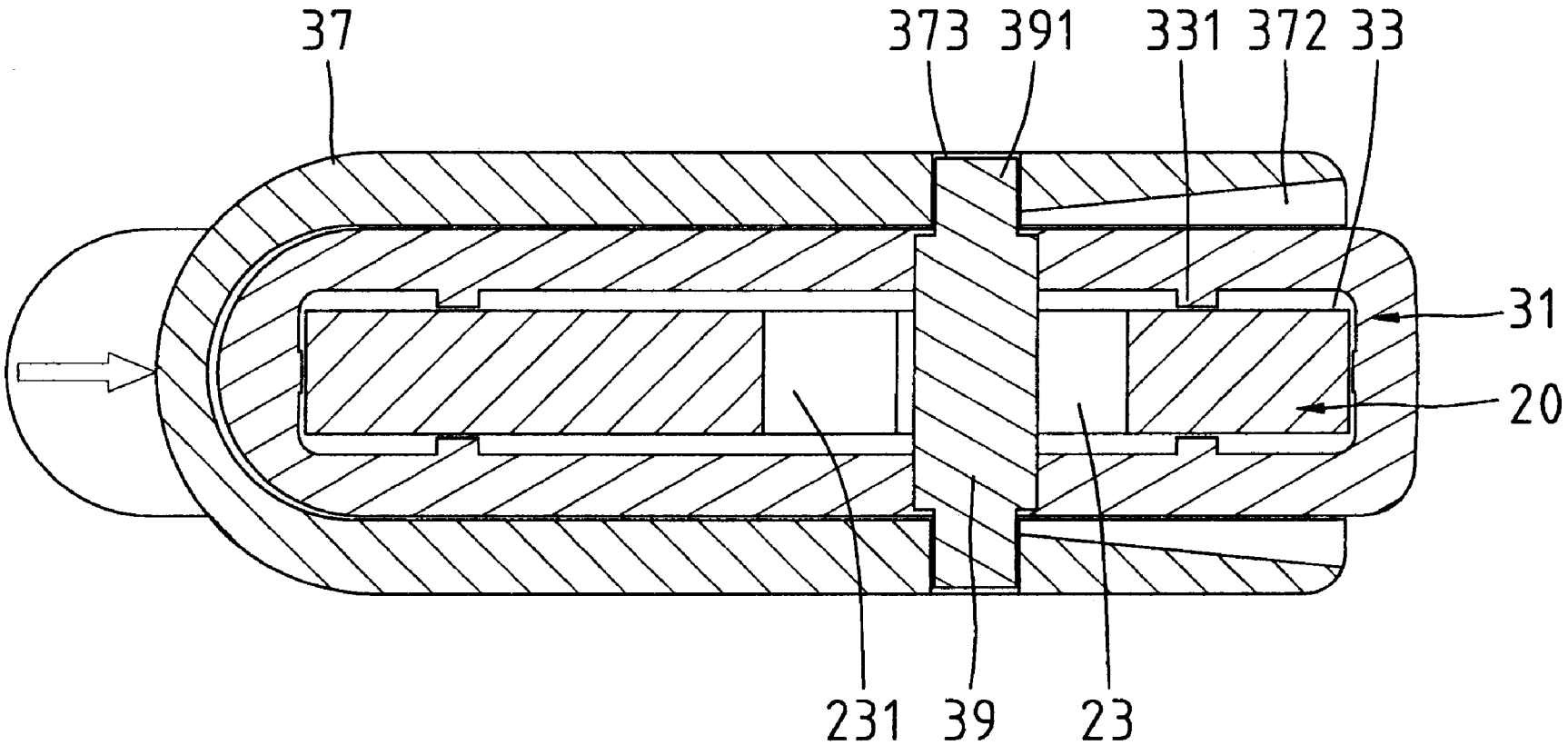
FIG. 7 is a view similar to FIG. 5, wherein the control member is pushed to proceed with height-adjustment of the armrest.
Figure 8:
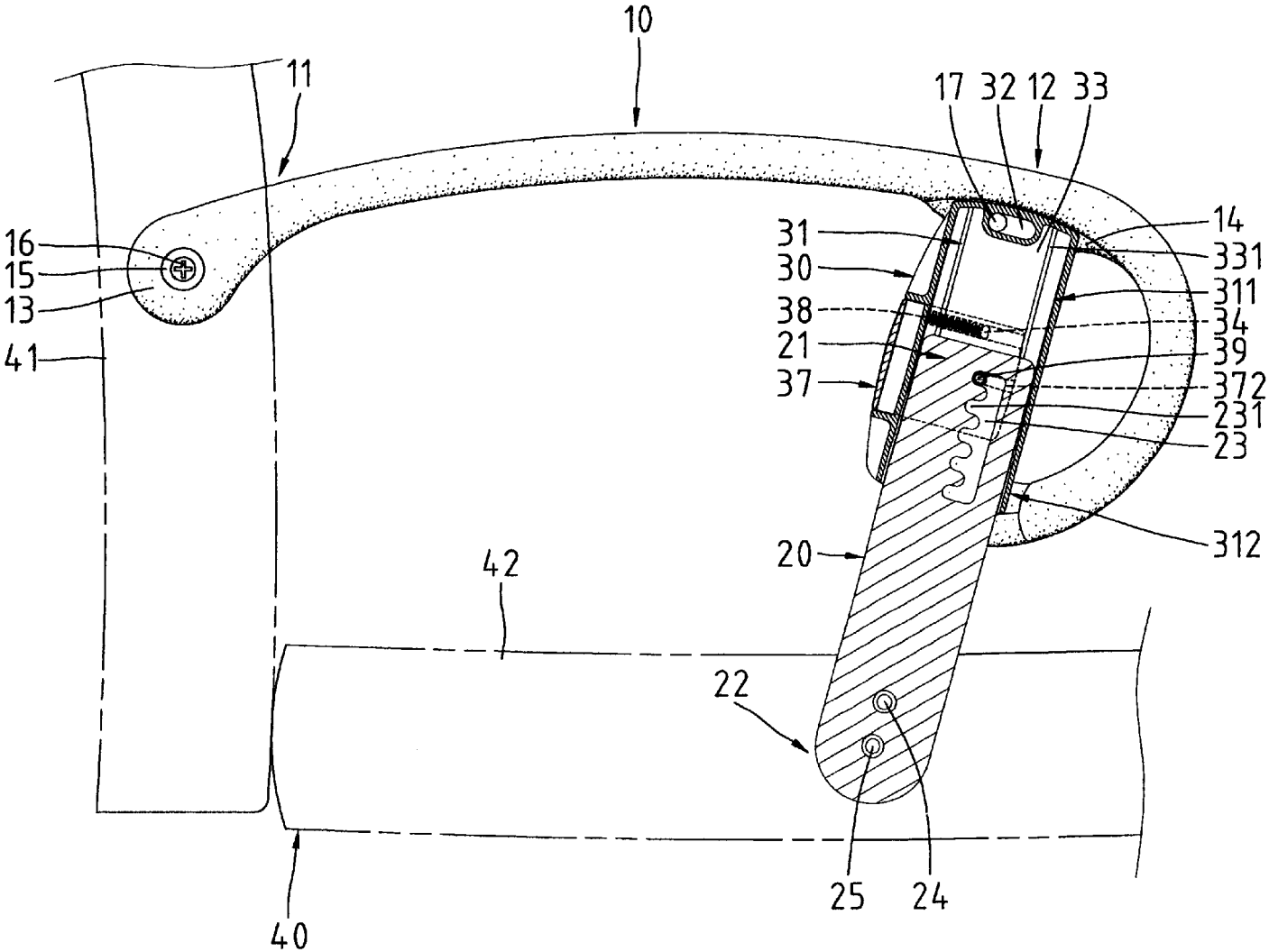
FIG. 8 is a view similar to FIG. 2, wherein height-adjustment of the armrest is finished.

Referring to FIGS. 6 and 7, when adjusting the height (i.e., the level) of the armrest 10, the control member 37 is pushed to overcome the elastic elements 38 and to disengage the positioning pin 39 from the positioning notches 231. The block 31 is now movable relative to the fixed member 20. Namely, the user may adjust the level of the armrest 10 by means of moving the adjusting means 30 upward or downward relative to the fixing member 20. The armrest 10 pivots about the axis of the screw 16 at the first end 11 of the armrest 10 during upward or downward movement of the adjusting means 30 relative to the fixing member 20. When the armrest 10 reaches the desired level, e.g., the highest position shown in FIG. 8, the control member 37 is released, which causes the positioning pin 39 to be engaged in an associated engaging notch 231 under the action of the elastic elements 38.

Figure 9:
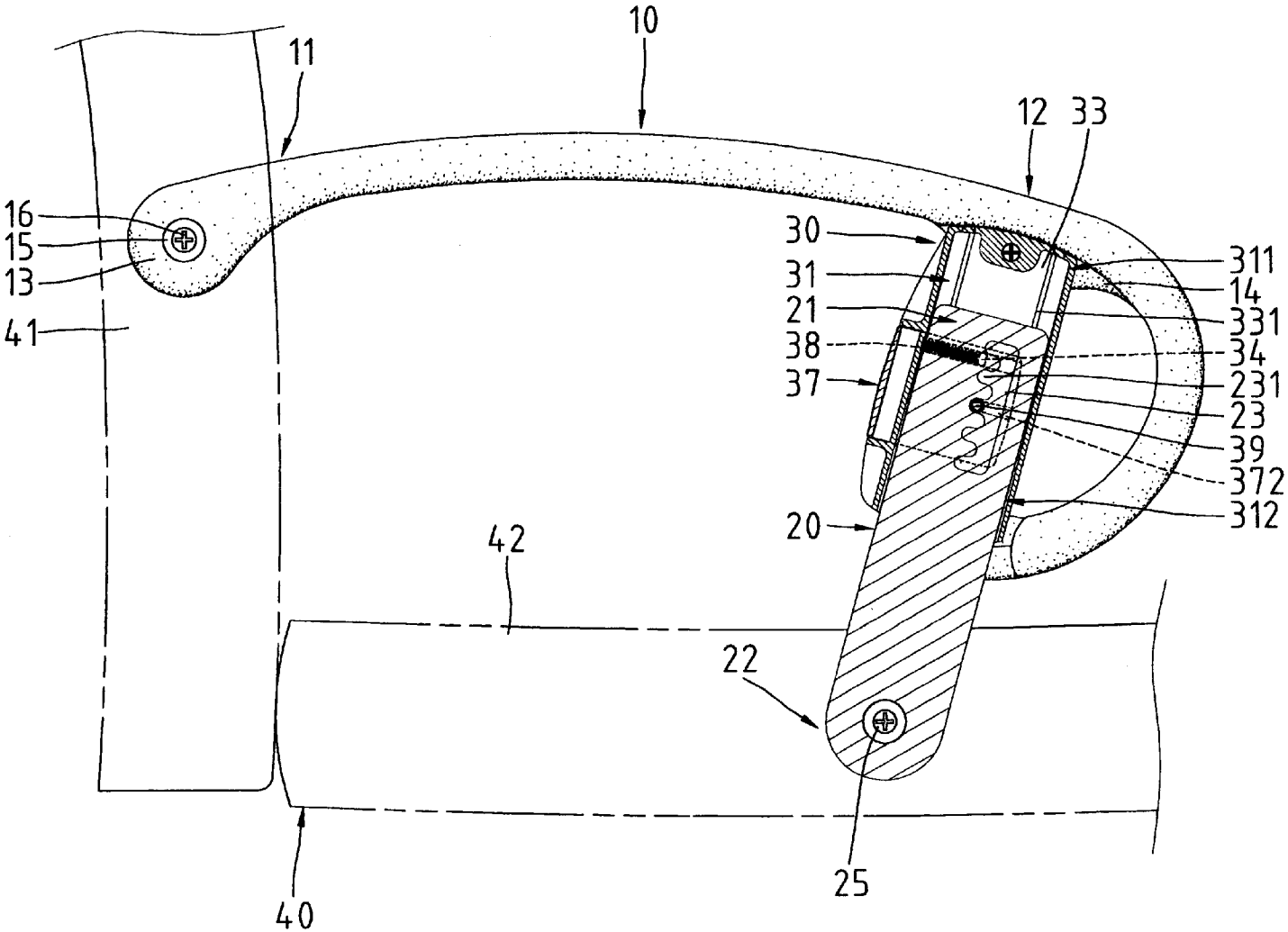
FIG. 9 is a view similar to FIG. 2, illustrating a modified embodiment of the invention.

FIG. 9 illustrates a modified embodiment of the invention, wherein the second end 22 of the fixing member 20 is pivotally mounted by a screw 25 to the seat 42 of the chair 40 to allow pivotal movement of the fixing member 20 relative to the seat 42. In addition, the first end 311 of the block 31 of the adjusting means 30 is fixedly mounted to the second end 12 of the armrest 10. Thus, when moving the second end 312 of the block 31 relative to the fixing member 20 to adjust the level of the armrest 10, the armrest 10 together with the first end 311 of the block 31 pivots about the axis of the screw 16 at the first end 11 of the armrest 10, and the fixing member 20 also pivots about an axis of the screw 25.

Figure 10:
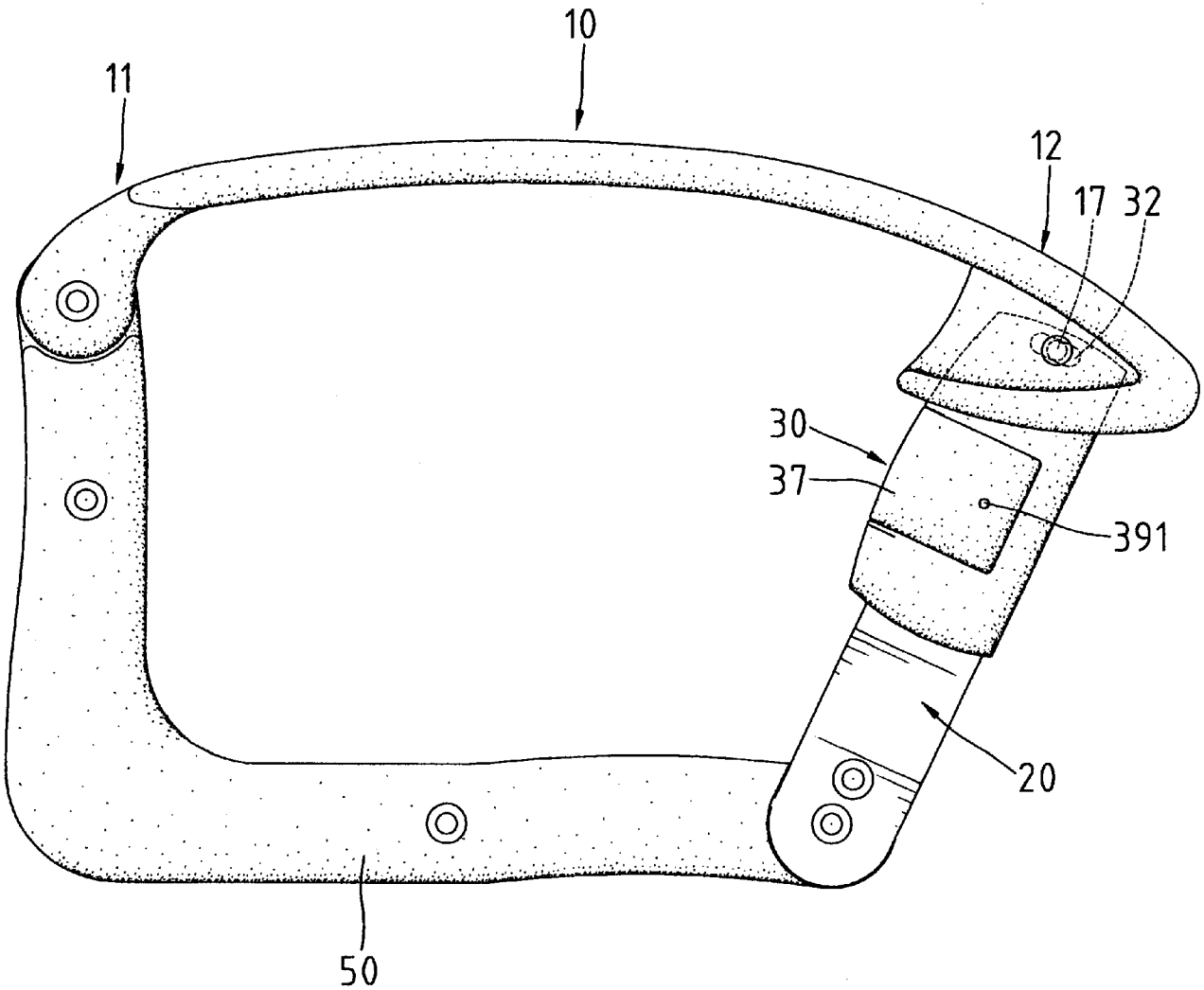
FIG. 10 is a view similar to FIG. 2, illustrating another modified embodiment of the invention.

FIG. 10 illustrates another modified embodiment of the invention, wherein the seat and the backrest of the chair is integrally formed as a base 50. The armrest 10 is pivotally mounted to an end of the base 50 and the fixing member 20 is mounted to the other end of the base 50. Of course, the base 50 can be replaced by a bracket that is attached to the seat and/or the backrest of a chair.

Although the invention has been explained in relation to its preferred embodiment, it is to be understood that many other possible modifications and variations can be made without departing from the scope of the invention as hereinafter claimed.

What is claimed is:

1. An armrest assembly for a chair having a seat and a backrest, the armrest assembly comprising:

an armrest having a first end pivotally attached to a backrest of the chair and a second end;

a fixing member having a first end fixed to a seat of the chair and a second end; and an adjusting means having a first end engaged with the second end of the armrest in a manner allowing relative sliding movement therebetween when the first end of the armrest pivots, the adjusting means further having a second end slidably engaged with the second end of the fixing member such that movement of the adjusting means relative to the fixing member causes a change in a height of the armrest, and the adjusting means and the fixing member being so configured that the adjusting means and the fixing member are engaged together when the adjusting means is in a first position and that the adjusting means and the fixing member are movable relative to each other when the adjusting means is in a second position.

2. The armrest assembly as claimed in claim 1, wherein the adjusting means comprises a block and a control member, the block comprising a first end slidably engaged with the second end of the armrest, the block further comprising a second end and a compartment having an opening in the second end of the block for receiving the second end of the fixing member, the control block being slidably attached to the block for controlling engagement between the block and the fixing member.

3. The armrest assembly as claimed in claim 2, wherein the second end of the fixing member comprises a row of vertically spaced engaging notches, a positioning pin being extended through the block and the engaging notches and having two ends secured to the control member to move therewith, such that the positioning pin is disengaged from the engaging notches when the control member is in a first position and that the positioning pin is engaged in one of the engaging notches when the positioning pin is in a second position.

4. The armrest assembly as claimed in claim 3, wherein the control member is substantially U-shaped and having two sidewalls, a transverse positioning hole extending through the sidewalls for receiving the ends of the positioning pin.

5. The armrest assembly as claimed in claim 4, wherein each of the sidewalls of the control member comprises a guide groove in an inner face thereof, the transverse positioning hole intersecting the guide grooves, the positioning pin being guided into the transverse positioning hole via the guide grooves.

6. The armrest assembly as claimed in claim 4, wherein the block has a transverse guide slot that is communicated with the compartment, the second end of the armrest comprising an engaging groove in an underside thereof, a pinhole being defined in a sidewall defining the engaging groove, further comprising a pin extending through the pinhole and the transverse guide slot, thereby allowing relative sliding movement between the second end of the armrest and the first end of the block during pivotal movement of the first end of the armrest.

7. The armrest assembly as claimed in claim 3, wherein the block comprises two protrusions formed on two sides thereof, further comprising two elastic elements attached between the protrusions and the control member for biasing the control member to its second position.

8. An armrest assembly for a chair having a seat and a backrest, the armrest assembly comprising:

a bracket securely attached to one of a seat of a chair and a backrest of the chair, the bracket having a first end and a second end, an armrest having a first end pivotally attached to the first end of the bracket and a second end;

a fixing member having a first end fixed to the second end of the seat and a second end; and an adjusting means having a first end engaged with the second end of the armrest in a manner allowing relative sliding movement therebetween when the first end of the armrest pivots, the adjusting means further having a second end slidably engaged with the second end of the fixing member such that movement of the adjusting means relative to the fixing member causes a change in a height of the armrest, and the adjusting means and the fixing member being so configured that the adjusting means and the fixing member are engaged together when the adjusting means is in a first position and that the adjusting means and the fixing member are movable relative to each other when the adjusting means is in a second position.

9. The armrest assembly as claimed in claim 8, wherein the adjusting means comprises a block and a control member, the block comprising a first end slidably engaged with the second end of the armrest, the block further comprising a second end and a compartment having an opening in the second end of the block for receiving the second end of the fixing member, the control block being slidably attached to the block for controlling engagement between the block and the fixing member.

10. The armrest assembly as claimed in claim 9, wherein the second end of the fixing member comprises a row of vertically spaced engaging notches, a positioning pin being extended through the block and the engaging notches and having two ends secured to the control member to move therewith, such that the positioning pin is disengaged from the engaging notches when the control member is in a first position and that the positioning pin is engaged in one of the engaging notches when the positioning pin is in a second position.

11. The armrest assembly as claimed in claim 10, wherein the control member is substantially U-shaped and having two sidewalls, a transverse positioning hole extending through the sidewalls for receiving the ends of the positioning pin.

12. The armrest assembly as claimed in claim 11, wherein each of the sidewalls of the control member comprises a guide groove in an inner face thereof, the transverse positioning hole intersecting the guide grooves, the positioning pin being guided into the transverse positioning hole via the guide grooves.

13. The armrest assembly as claimed in claim 11, wherein the block has a transverse guide slot that is communicated with the compartment, the second end of the armrest comprising an engaging groove in an underside thereof, a pinhole being defined in a sidewall defining the engaging groove, further comprising a pin extending through the pinhole and the transverse guide slot, thereby allowing relative sliding movement between the second end of the armrest and the first end of the block during pivotal movement of the first end of the armrest.

14. The armrest assembly as claimed in claim 10, wherein the block comprises two protrusions formed on two sides thereof, further comprising two elastic elements attached between the protrusions and the control member for biasing the control member to its second position.

15. An armrest assembly for a chair having a seat and a backrest, the armrest assembly comprising:

an armrest having a first end pivotally attached to a backrest of a chair and a second end;

a fixing member having a first end pivotally attached to a seat of the chair and a second end; and an adjusting means having a first end securely engaged with the second end of the armrest, the adjusting means further having a second end slidably engaged with the second end of the fixing member such that movement of the adjusting means relative to the fixing member causes a change in a height of the armrest, and the adjusting means and the fixing member being so configured that the adjusting means and the fixing member are engaged together when the adjusting means is in a first position and that the adjusting means and the fixing member are movable relative to each other when the adjusting means is in a second position.

16. The armrest assembly as claimed in claim 15, wherein the adjusting means comprises a block and a control member, the block comprising a first end securely engaged with the second end of the armrest, the block further comprising a second end and a compartment having an opening in the second end of the block for receiving the second end of the fixing member, the control block being slidably attached to the block for controlling engagement between the block and the fixing member.

17. The armrest assembly as claimed in claim 16, wherein the second end of the fixing member comprises a row of vertically spaced engaging notches, a positioning pin being extended through the block and the engaging notches and having two ends secured to the control member to move therewith, such that the positioning pin is disengaged from the engaging notches when the control member is in a first position and that the positioning pin is engaged in one of the engaging notches when the positioning pin is in a second position.

18. The armrest assembly as claimed in claim 17, wherein the control member is substantially U-shaped and having two sidewalls, a transverse positioning hole extending through the sidewalls for receiving the ends of the positioning pin.

19. The armrest assembly as claimed in claim 18, wherein each of the sidewalls of the control member comprises a guide groove in an inner face thereof, the transverse positioning hole intersecting the guide grooves, the positioning pin being guided into the transverse positioning hole via the guide grooves.

20. The armrest assembly as claimed in claim 17, wherein the block comprises two protrusions formed on two sides thereof, further comprising two elastic elements attached between the protrusions and the control member for biasing the control member to its second position.

* * * * *